US005863130A

United States Patent [19]

Nguyen

[11] Patent Number: 5,863,130

[45] **Date of Patent: *Jan. 26, 1999**

[54] SELF OPENING THERMOPLASTIC BAG SYSTEM

[76] Inventor: Tai H. Nguyen, 83 Monterrey Dr., Kenner, La. 70065

[ * ] Notice: The term of this patent shall not extend beyond the expiration date of Pat. No. 5,363,965.

[21] Appl. No.: 717,083

[22] Filed: Oct. 7, 1996

Related U.S. Application Data

[63] Continuation-in-part of Ser. No. 337,167, Nov. 10, 1994, Pat. No. 5,561,967, which is a continuation-in-part of Ser. No. 124,278, Sep. 20, 1993, Pat. No. 5,363,965.

[51] Int. Cl.[6] ..... B65D 33/10

[52] U.S. Cl. ..... 383/9; 383/37; 206/554

[58] Field of Search ..... 206/554; 53/452, 53/390; 383/9, 37

[56] References Cited

U.S. PATENT DOCUMENTS

| | | | |
|---|---|---|---|
| 3,869,065 | 3/1975 | Wang . | |
| 4,676,378 | 6/1987 | Baxley et al. . | |
| 5,013,290 | 5/1991 | DeMatteis . | |
| 5,183,158 | 2/1993 | Boyd et al. . | |
| 5,213,145 | 5/1993 | Huang et al. . | |
| 5,269,605 | 12/1993 | Nguyen | 383/9 |
| 5,335,788 | 8/1994 | Beasley et al. . | |

*Primary Examiner*—Scott W. Houtteman
*Attorney, Agent, or Firm*—Joseph T. Regard, Ltd.

[57] ABSTRACT

A bag and dispensing system system wherein the thermoplastic bag to be dispensed may be retained in an open position, to allow for the loading thereof with contents for carrying, such as purchased goods or the like. The system is further configured such that the loaded bag, when dispensed, draws the next bag in the stack forward into an open loading position such that it is ready to be loaded with goods without further manipulation by the attendant. The preferred embodiment of the present invention teaches the utilization multi-edged penetration punch applied to the handle area of the bags to hold said handles together for handling of the bag pack, and for facilitating opening of the next bag in the stack on the rack, when a loaded bag is removed. The preferred embodiment of the present invention utilizes co-extruded film, wherein there is provided a high density film having bonded thereto a lower density film of lesser density than said high density film, such that said lower density film forms the exterior side of said co-extruded film. The co-extruded film is then corona treated at a higher energy level than that recommended for facilitating a printing surface on said film. Said film is then die-cut to form bag stacks, and simultaneously punched with the multi-faceted punch in the area of the handles. This punch penetrates the film forming the bag walls, melding the adjacent walls together in a releasable fashion, allowing self opening of said bags.

18 Claims, 8 Drawing Sheets

SELF OPENING THERMOPLASTIC BAG SYSTEM

STATEMENT OF CONTINUING INVENTION

The present invention is a continuation-in-part of U.S. Pat. No. 5,561,967, issued Oct. 8, 1996, filed Nov. 10, 1994, having Ser. No. 08/337,167 listing as inventor Tai H. Nguyen, entitled "Self Opening Thermoplastic Bag System", which is a continuation-in-part of U.S. Pat. No. 5,363,965, issued Nov. 15, 1994, filed Sep. 20, 1993, having Ser. No. 08/124,278 entitled "Self-Opening Thermoplastic Bag System", listing as inventor Tai Nguyen.

BACKGROUND OF THE INVENTION

Invention Field

The present invention relates to bag dispensing systems, and particularly to a bag and system for dispensing self-opening thermoplastic bags or the like from a stack of bags. The present system is configured such that it may be utilized with a variety of off-the-shelf rack configurations, and to provide optimal characteristics for dispensing bags one at a time, while further providing a system wherein the bag to be dispensed may be retained in an open position, to allow for the loading thereof with contents for carrying, such as purchased goods or the like. The system is further configured such that the loaded bag, when dispensed, draws the next bag in the stack forward into an open loading position such that it is ready to be loaded with goods without further manipulation by the attendant.

The preferred embodiment of the present invention teaches the utilization of a star, X, cross-configured, or other multi-edged penetration punch applied to the handle area of the bags as a pack in such a manner as provide a punched region in the pack, to hold said handles together for handling of the bag pack, and for facilitating opening of the next bag in the stack on the rack, when a loaded bag is removed.

The self-opening characteristics of the present invention have been found to be greatly improved via the utilization of a co-extruded film, wherein there is provided a mostly high density film having bonded thereto a mostly low density, or even in some formulations a medium density film of substantially lesser thickness than said high density film, such that said low density film forms the exterior, exposed side of the tube of said co-extruded film.

The co-extruded film is then corona treated at a higher energy level than that recommended for facilitating a printing surface on said film. Said film is then die-cut to form bag stacks, and simultaneously punched with the multi-faceted punch in the area of the handles. This punch penetrates the film forming the bag walls, melding the adjacent walls together in a releasable fashion, facilitating holding of the bag handles in the bag pack for transport and loading on to a bag dispenser, and providing a means for opening the next bag to be dispensed upon removal of a bag from the dispenser.

GENERAL BACKGROUND DISCUSSION

Although the prior art has contemplated literally hundreds of various designs for bags and bag dispensing systems, relatively few have proved easily implemented and few yet have proved consistent in performance.

A list of prior patents which may be of interest is presented below

| Patent No. | Inventor(s) | Issue Date |
|---|---|---|
| 5,335,788 | Beasley et al | August 09, 1994 |
| 5,123,145 | Huang et al | May 25, 1993 |
| 5,183,158 | Boyd et al | Feb 02, 1993 |
| 5,014,852 | Herrington et al | May 14, 1991 |
| 5,013,290 | DeMatteis | May 07, 1991 |
| 4,989,732 | Smith | Feb 05, 1991 |
| 4,676,378 | Baxley et al | Jun 30, 1987 |
| 4,562,925 | Pistner | Jan 07, 1986 |
| 3,869,065 | Wang | Mar 04, 1975 |

U.S. Pat. Nos. 4,989,732 and 5,183,158 to Mobil Oil Corporation teaches a self opening bag system wherein there is contemplated a thermoplastic bag pack having handles emanating from opposing sides of a bag mouth, wherein there is provided a pressure bonded area of the pack, such that the plastic film of the bags are in "face to face" engagement between the top and base of the handles, and beneath the medial area of the bag mouth.

The Mobil patents are distinguishable from the present invention, as they contemplate a non-permeating engagement of the film in the various layers of plastic forming the bag pack. Further, unlike the Mobil patents, the present invention does not require pressure-bonding below the mouth of the bags, as is specifically contemplated, and believed required, for the Mobil system to work.

Unlike Mobil, the present systems punch configuration for providing a permeated, releasible pressure bond provides sufficient releasable binding of the film layers, via melding of the severed film, to draw the next bag open for dispensing, with the removal of the full bag from the rack, without the necessity of the medial pressure bond below the bag mouth as in '732, as well as a separate pressure bond at the base of the bag and pack, as contemplated and claimed in '158.

U.S. Pat. No. 5,013,290 to DeMatteis contemplates a t-shirt bag pack formed of co-extruded plastic film, wherein the inner layer comprises a relatively low friction coefficient, the outer layer comprises a generally high friction coefficient, said t-shirt bag pack having formed in the handles a handle aperture having a flap designed to rest upon the rods of a dispenser rack in such a manner such that the flaps are oriented so that they are disposed away from the mass of the bags to pass the weight of the bag pack of said bundle downward through the flaps and onto said rods. The patent refers to the high friction, outer layer of the co-extrusion being formed of low density polyethylene resin (LDPE), the inner layer formed of high density polyethylene resin (HDPE).

U.S. Pat. No. 5,335,788 to Sonoco Products Company teaches a "Self-Opening Polyethylene Bag Stack and Process for Producing Same", teaching a mono-extruded bag formed from HDPE film, said film having a corona treatment applied thereto. Quoting this patent (Col 1, Ln 67–Col2 Ln45):

"In general, the phenomenon of corona-induced self-adhesion of polyethylene film is not a new development as far as film processors are concerned. On the contrary, processors continually fought this problem, more commonly known as "blocking" for many years. In fact, most LDPE and LLDPE contain specific amounts of slip and anti-block additives to counteract the "blocking" effect. However, high molecular weight, high density polyethylene (HDPE) which has substantially greater crystallinity and is a more substantially linear polymer does not tend to block, and is more often than not does not contain any slip or antiblock additives.

The mechanism of hydrogen bonding in polyethylene films a result of corona treating is reported by Owens in J. Appl. Polym. Sci. 19, 256–271 (1975). The polyethylene films treated by Owens were LLDPE (the material was reported to have a density of 0.926). However, the conditions of heat and pressure which readily caused blocking in corona treated LDPE and LLDPE seem to have little or no effect on HDPE.

Apparently for similar reasons, although the process disclosed in Prader U.S. Pat. No. 5,087,234 can be successfully employed on low density polyethylene materials to form self-opening bag stacks, this process is generally ineffective when used for high molecular weight, high density polyethylene (HDPE) bag stacks. Thus, this process is not successful even when the degree of corona discharge treatment is applied to the surfaces of the tubular film is increased in order to induce self-adhesion of the outer surfaces of adjacent bags during the mouth and handle cutting process. Similarly, even when the cutting blade edges are dulled in order to increase the degree of pressure exerted on the bags during the cutting process, self-adhesion of adjacent bags for self opening is not achieved with HDPE.

Accordingly, although easy-open bag stacks of LLDPE and LDPE film bags can be readily provided without the necessity of a separate adhesive layer between the bags, a separate adhesive layer is still required between HDPE bags when these bags are prepared by prior art manufacturing process. Moreover, with low density polyethylene materials, the known process for forming self-opening bags such as described in U.S. Pat. No. 5,087,234 to Prader to not allow for substantial adjustment of the degree of bonding between adjacent bags or variation of bonding locations."

Unlike the present invention, the '788 patent not only appears to contemplate a film of at least 50% HDPE in the compression area, but also teaches a compression means utilizing a blunt end punch, wherein the compressed film is not severed, the blunt punch apparently compressing the bag walls together resulting in decreased thickness. Further, the above quote teaches that the novelty '788 rests in the ability to corona treat and punch HDPE bags in order to provide an HDPE bag stack having self-opening characteristics, the quote apparently indicating that corona treating LDPE is not particularly new. Unlike '788, the present invention contemplates a system utilizing co-extruded film, wherein the outer layer comprises mostly, if not all, LDPE or LLDPE product. Further '788 does not contemplate the utilization of a punch formed of a multi-faceted cutting blades, as is shown and claimed in the present invention, which punch penetrates and severs the bag walls, melding the cut edges together, as opposed to compressing them together, as is taught in '788.

SUMMARY DISCUSSION OF THE INVENTION

Unlike the prior art, the present invention provides a self opening bag and dispenser system which is consistent in performance, and comparatively strong and reliable, while being inexpensive to manufacture, requiring little in the way of custom manufacturing equipment.

The present invention is taught in the preferred embodiment of the present invention is to be utilized in conjunction with a pack of T-shirt thermoplastic bags or the like, which are dispensed from a rack having first and second elongated, somewhat horizontally displaced bag handle holding members, and a central tab piece emanating from the bag mouth.

As taught, the present invention teaches the application of two punches in the same general vicinity in the handle area of a bag pack, said punches having multi-facted cutting edges in the configuration of, for example, star, X, or cross configurations.

It has been found that this configuration punch, which not only applies a pressure bond to the plastic film forming the bags and bag pack, but also permeates said walls, provides sufficient bonding between the walls to allow for the consistent dispensing of a bag from the pack with the removal from the rack of a previously dispensed bag. Other configured punches have failed to perform in such a manner.

The preferred embodiment of the present invention further contemplates the utilization of a co-extruded film comprising a first ply of mostly HDPE (up to 75–80%+ HDPE), and a second ply of LDPE or LLDPE (linear low density polyethylene), said co-extruded film formed into a bag pack such that the first ply forms the inner walls of the bag, and the second ply forms the outer wall of the bag. The coextruded film is then corona treated at an intensity which exceeds that of traditional corona treatment for providing a printable surface, in order to treat the low density outer layer to facilitate a better bonding surface, further enhancing the bond, providing a higher bonding between adjacent exterior, low density outer walls of adjacent bags via the punch of the present invention.

The coextrusion of the present invention provides a more economical, stronger, better self-opening bag than prior art systems. In the present invention, the first ply, formed of HDPE, may have a thickness comprising up to, for example, 80+% of the co-extruded, two ply film, while the second ply, formed of the LDPE or LLDPE, may only comprise 20% or less of the density of the co-extruded, two ply film. Occidental Chemical Company of Texas has indicated that Polyethylene resins having a density above 0.94 are referred to as High Density. Medium, Low, and Linear Low density have a density of less than 0.94. As HDPE is a stronger film than MDPE, LDPE, or LLDPE, it is advantageous to have as high an HDPE content as possible. However, HDPE does not print so well, and, in mono-extruded, single ply systems, it is often necessary to blend HDPE with MDPE, LDPE or LLDPE in order to provide a printable surface, which may have to be corona treated to allow for retention of the ink. This blending, which can be 20%, 30%, and even 40%+, can result in significant weakening of the film. Further, blending may be necessary for providing a pack which will self open when punched, as contemplated in the '788 patent, resulting in a weakened film for the sake of making the system self opening. Lastly, low density resin may be expensive compared to high density, so it behooves one to utilize as little low density resin as possible.

The present system allows one to utilize, proportionally, a lesser percentage of low density or linear low density polyethylene in a two ply, coextruded context, than would be implemented in a typical monoextrusion context, resulting in superior strength, better bonding, and at a perceived lesser overall cost.

It is therefore an object of the present invention to provide a self opening bag system which may be utilized with a variety of configurations of bag packs to be dispensed from a rack.

It is another object of the present invention to provide a self opening bag system which utilizes significantly less LDPE or LLDPE than other systems, while capitalizing on the benefits of LDPE or LLDPE, without the weaknesses or costs associated with other systems.

It is another object of the present invention to provide a self opening bag system which is relatively easily implemented, cost effective, and reliable.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE INVENTION

Figure 1:
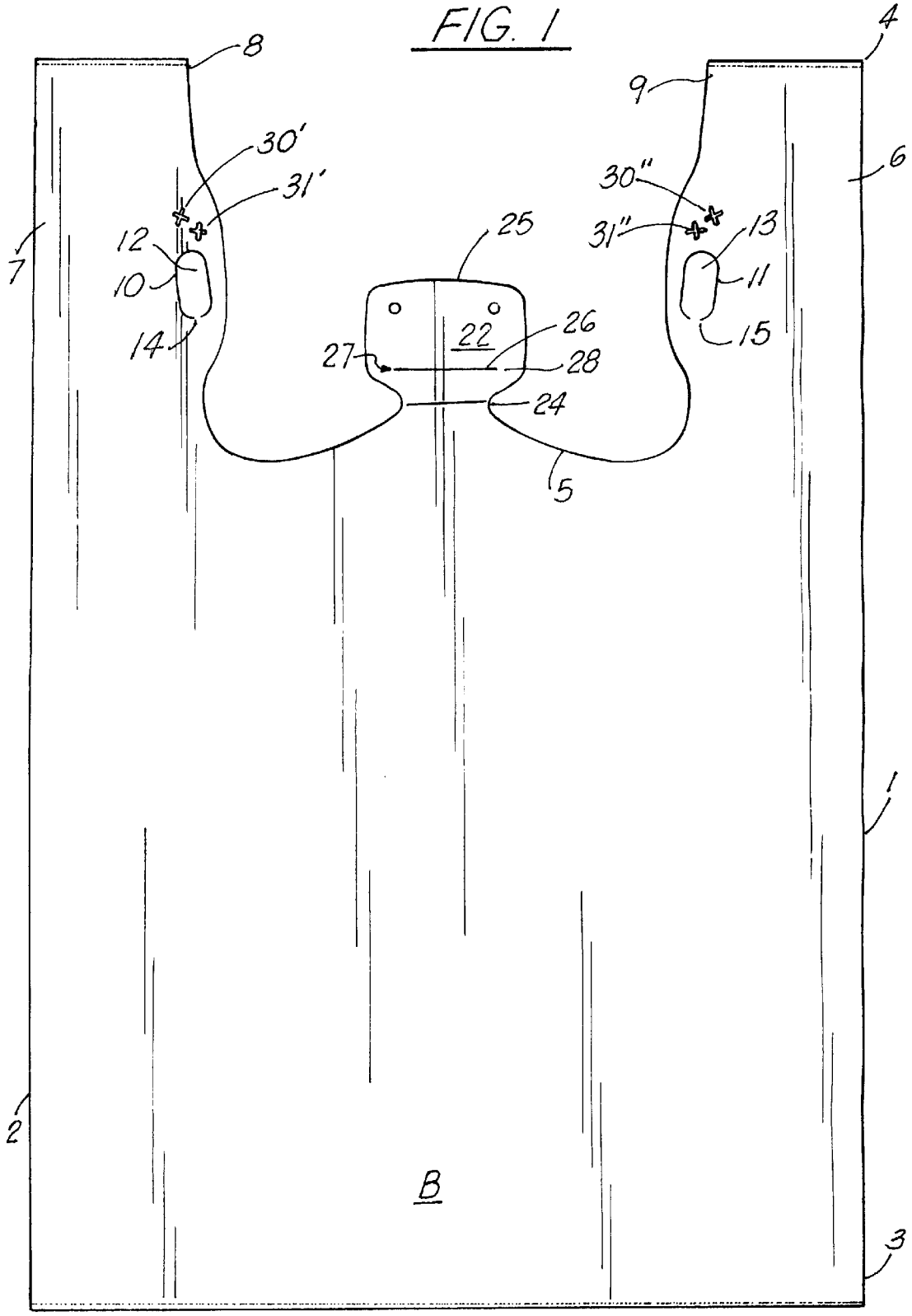
FIG. 1 is a frontal view of the bag of the preferred, exemplary embodiment of the present invention, illustrating the self-opening punch configuration and placement thereof.
Figure 6:
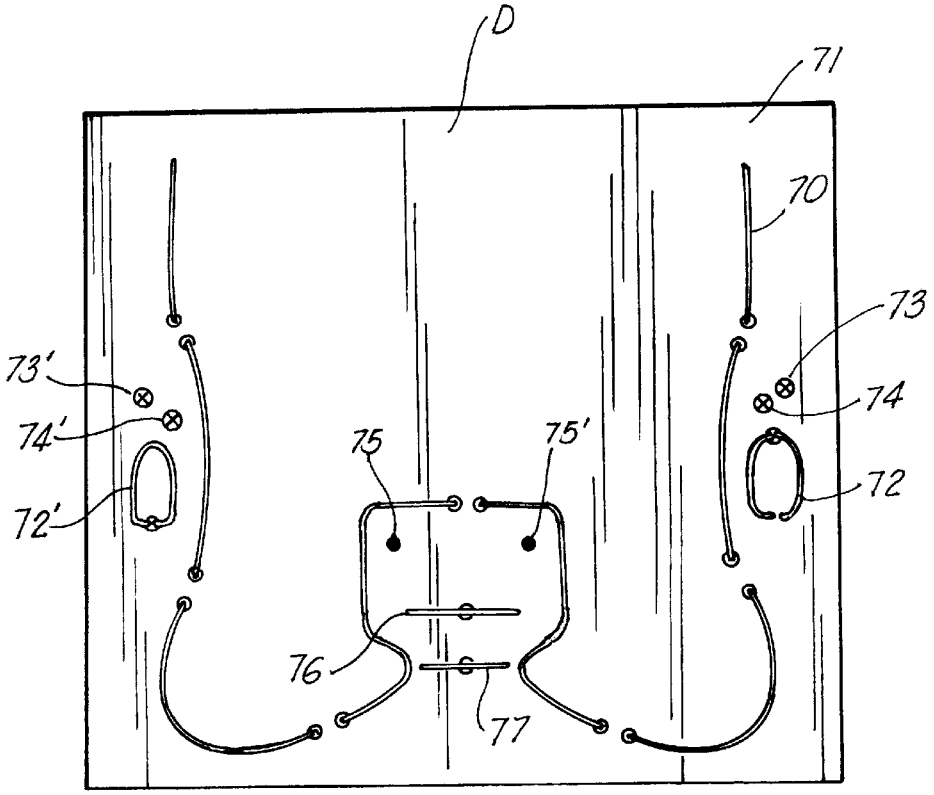
FIG. 6 is a top view of an exemplary die for forming the bag pack of the present invention, including cutting blades for forming the handle, handle apertures and mouth area of each bag and the bag pack, as well as exemplary placement of the self opening die punches.

As can be seen in FIG. 1, the bag B of the preferred, exemplary embodiment of the present invention, includes first 1 and second 2 sides, a bottom 3 and top 4 ends, and a mouth 5. Emanating from opposing ends of the mouth 5 are first 7 and second 6 handles, each handle having an inner side edge 8, 9, respectively. Further included in the handles 7, 6, are first and second handle support cuts 10, 11, respectively. Each handle support cut 10, 11, as shown has formed therein first 12 and second 13 tabs, respectively, connectively affixed to the handle via uncut portion forming tab connections 14, 15, respectively, at the bottom of said tabs 12, 13. The handle support cuts may be formed via cutting die or the like pressed upon and through the bag or bag pack, as shown in FIG. 6.

Emanating from the bag mouth 5 is dispensing tab 22, having a neck 24, and an upper, bulbous portion 23 having an end 25. Formed and situated in the bulbous portion 23 of tab 22 is the tab support cut 26 having first 27 and second 28 ends.

Figure 2A:
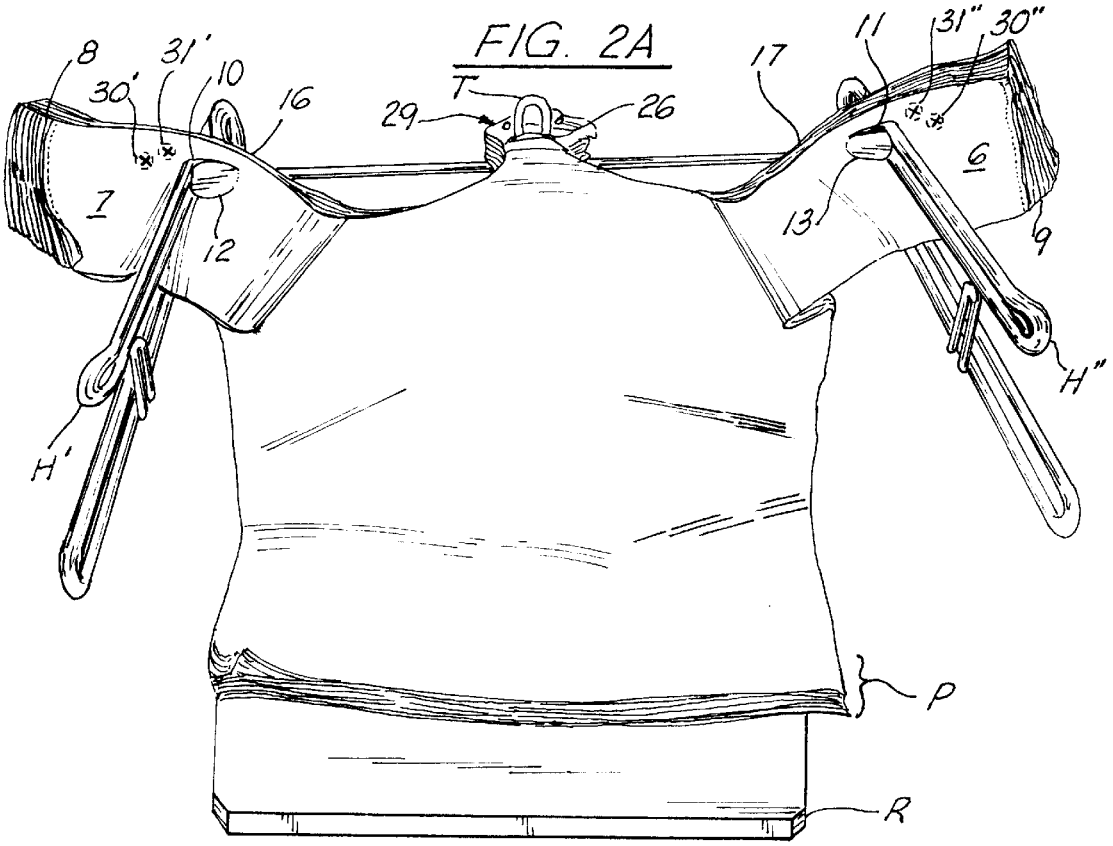
FIG. 2*a* is an isometric view of the bag pack of bags of FIG. 1, as it is placed upon an exemplary rack, illustrating the communication of the support cuts with the various rack support members, and the relation of the self-opening punches thereto.

As shown in FIG. 2A of the drawings, the bag pack P of the present invention may be dispensed upon a rack R having first and second, somewhat horizontally situated handle support members H', H", and a tab support member T, configured to communicate with handle support cuts 10, 11 and tab support cut 26, respectively.

The individual bags of the present invention are held together in a bag pack P via the utilization of a heated or cold punch 29, fusing the dispensing tabs 22 together. The multi-faceted linear punches 30',31' and 30", 31" are formed in the first and second handles, respectively, in the general area of the tabs 12, 13. As shown, both first 30', 30", and second 31', 31" punches may be positioned between the tops 8, 9 of the bag handles 7, 6 and the respective tab areas 12, 13; the second punches 31', 31" may be positioned generally near the inner edges 16, 17 of their respective bag handles 7, 6, with the first punches 30', 30" positioned more towards the medial area of the handles, between the inner edges and distal, outer edges of the bag handles. Further, the first and second punches may be of varying sizes, for example, the first punches may comprise a larger punch, for example, 10–50% larger than the second punches, in order to prevent weakening of the bag due to the second punches being closer to the inner edge than the first punches, which are further from either the inner or outer edges of the bag handles.

Figure 2B:
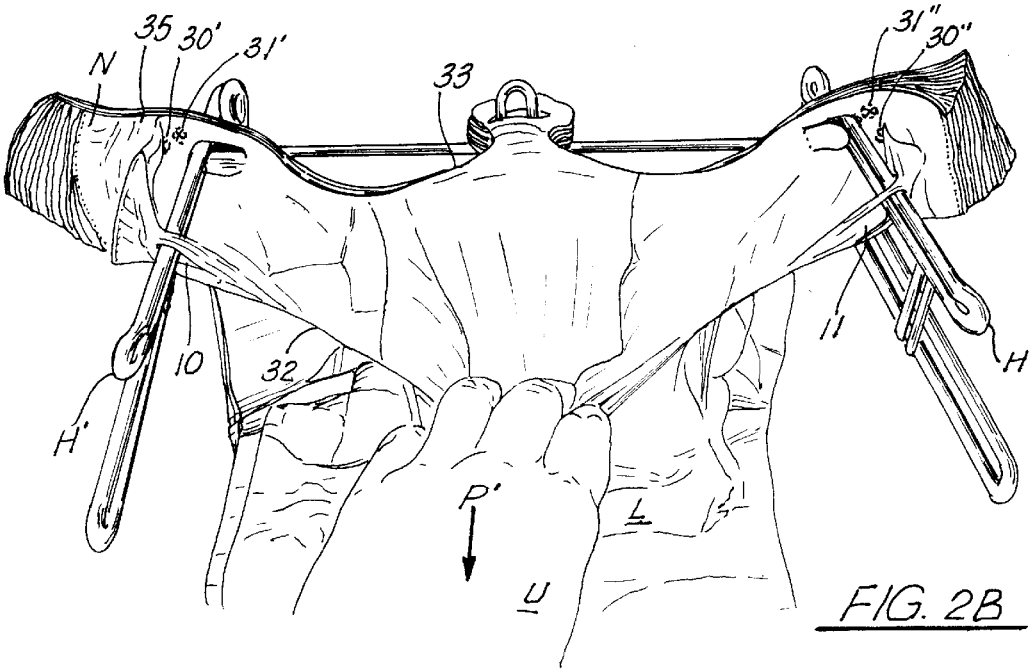
FIG. 2*b* is an isometric view of the bag pack of bags of FIG. 2*a,* illustrating a user opening a first bag on a rack, allowing the loading thereof.

As illustrated in FIG. 2B, the present invention is utilized in much the same manner as conventional T-shirt bags, with the lead bag first placed in the loading position by grasping and directing the first wall of the bag forward by pulling same P, thereby separating the first 32 and second 33 walls of the bag, and opening said bag into a separated, supported (via the handle support racks), loading position.

Figure 2C:
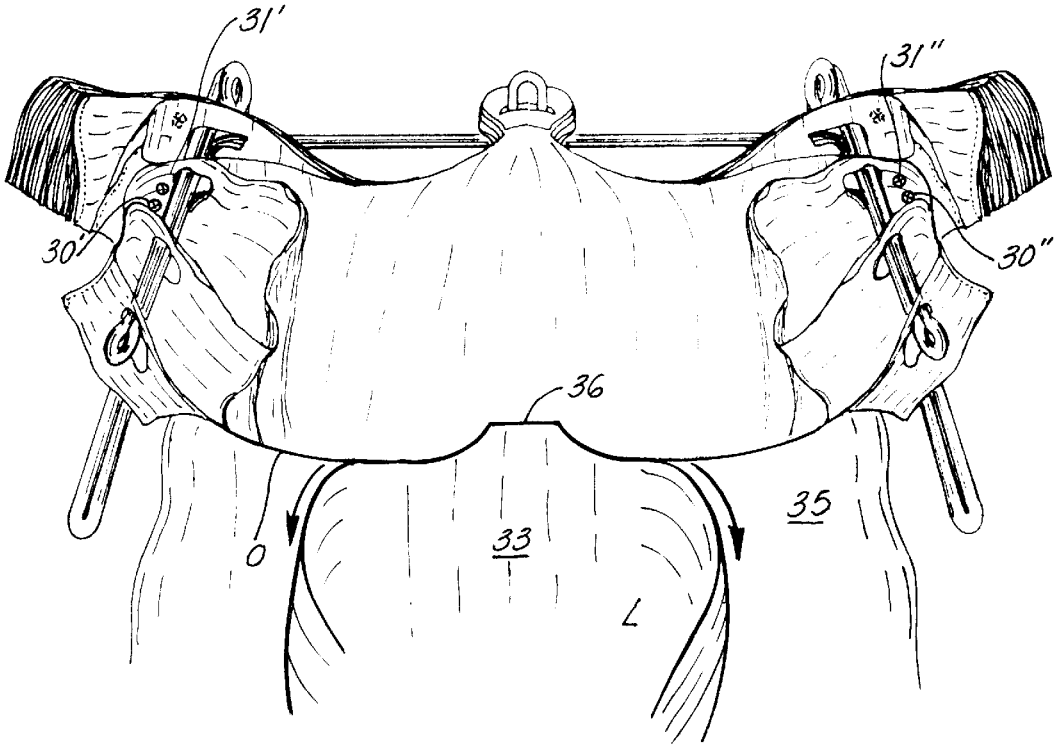
FIG. 2*c* is an isometric view of the bag pack of bags of FIG. 2*a,* illustrating a user removing the first bag of FIG. 2B, wherein the next bag on the rack has been opened by the removal of said first bag, via handle punches.

FIGS. 2B–2C illustrate the self-opening properties of the present system, utilzing the multi-facet punch design, which has been found to work as well with a star or cross punch configuration.

As shown, the user U pulls P the first wall 32 of the lead bag L loaded bag from the rack. In doing so, the bag handle support cuts 10, 11 ride along the handle support rods H, H" away from the bag pack. However, the punches 30', 30", 31', 31" formed in the rear wall 33 of the lead bag cause the handle area of the rear wall of the lead bag to adhere to the front wall 35 of the next bag N sufficient to break 36 the bond between the upper bag wall and the tab 5, allowing said front wall 35 to be directed into an open position O on the rack. Once the lead bag L is removed from the rack, as shown in FIG. 2D, the next bag, now in the open position, becomes the lead bag L', and the process repeats itself with the loading and removal of said bag, dispensing the next bag N', and so on.

Figure 2D:
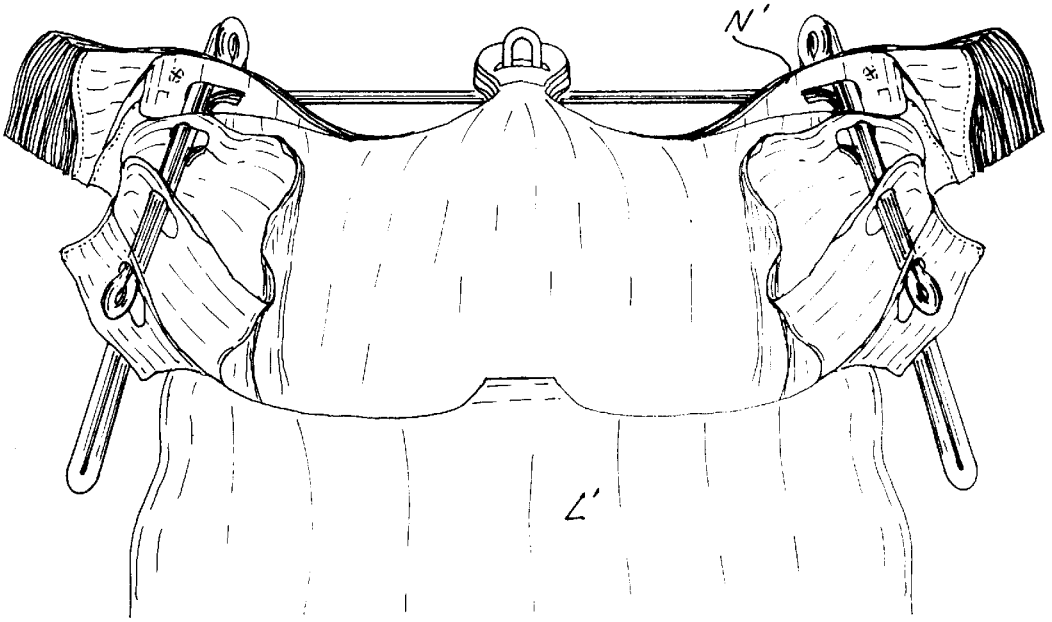
FIG. 2*d* is an isometric view of the bag pack of bags of FIG. 2*a*, illustrating the next bag has been fully opened by the removal of the first bag

Referring to FIGS. 2C–2D, the punches taught in the present invention permeate the walls of the bags such that the rear wall of the next bag N remains with the pack, and supported by tab 5, and hold the opened bag in place on the rack, as the lead bag is removed from the rack, the rear wall of the next bag holding said bag firm as the joined, punched area on the lead and next bag separates, as the lead bag is removed from the rack, before the rear wall 33 is removed from the support rods H', H", but after the next bag is placed in an open, ready to be loaded position.

Figure 3A:
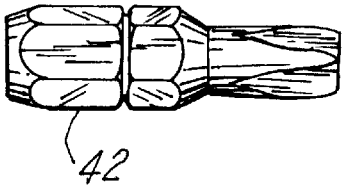
FIG. 3*a* is a side view of the preferred embodiment of the self-opening punch, illustrating the multi-faceted cutting blade configuration in the general form of a "+" or "×".
Figure 3B:
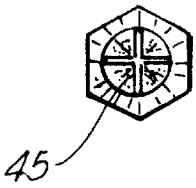
FIG. 3*b* is an end view of the punch of FIG. 3*a*, illustrating an end view.
Figure 3C:
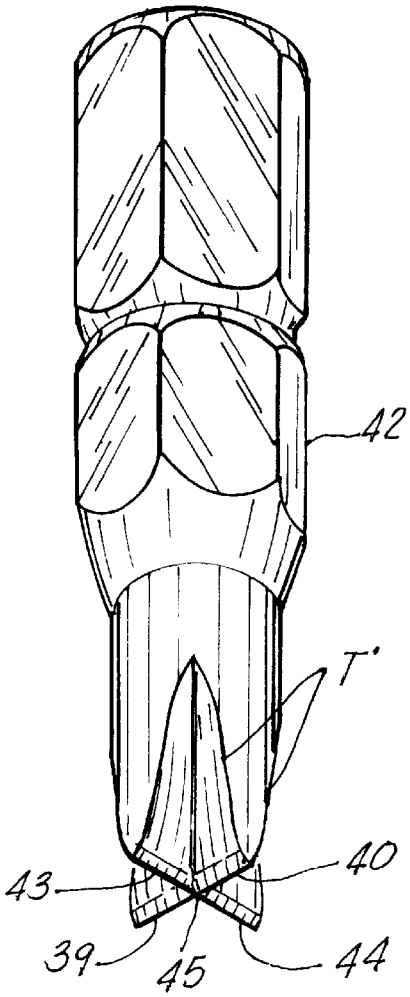
FIG. 3*c* is an isometric view of the punch of FIG. 3*a*, illustrating the overall configuration of said punch.

FIGS. 3A–3C illustrate the cross-configured punch 42 of the present invention, whereby there is provided a tip having first 39 and second 40 linear, longitudinal linear punch members perpendicularly intersecting with first 43 and second 44 linear, lateral punch members, forming a multi faceted, or multiple edged punch.

As further shown, each of the linear punch members are tapered T' to a generally linear end 45, forming the leading edge of the punch. It has been found that this multiple edged approach, which have tended to comprise generally linear edges, provides not only a penetrating and cutting of the bags forming the bag pack, but has also been found to meld the cut edges together of the adjacent, mostly low density outer walls of the adjacent bags, providing a releasable adhesive means which facilitates the self-opening operation of the present bag system.

Accordingly, other punches having similar characteristics may also work in the fashion described in the present invention, as long as they comprise a plurality of punch members forming a multi-edged or multi-faceted punch. The punch, when applied, should partially meld the outer bag walls such that the rear, outer wall of the lead bag in a bag pack is releasably melded with the front, outer wall of the next bag in the pack. Although the preferred embodiment of the present invention contemplates the utilization of a linear cutting edge forming the leading edge of the punch, it is anticipated that non-linear, or radial leading cutting edges may also be implemented with favorable results.

Figure 4:
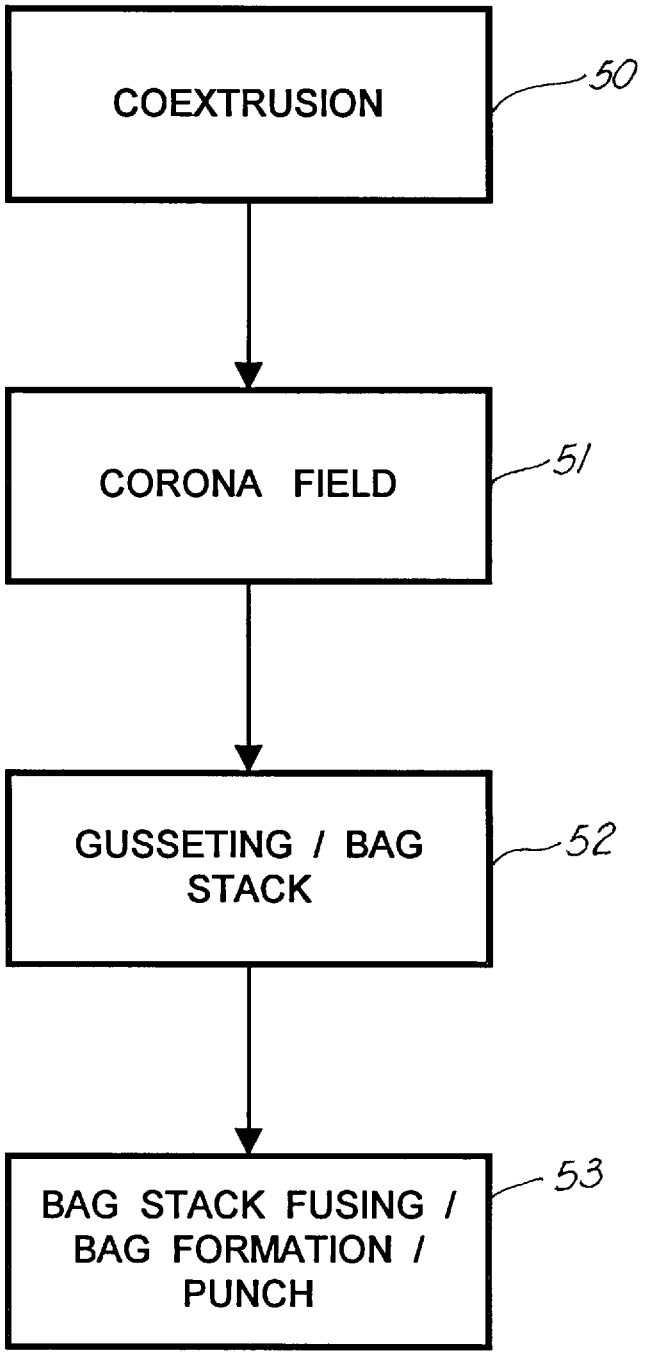
FIG. 4 is a flow chart illustrating the basic steps in forming the bag pack of the present invention.
Figure 5:
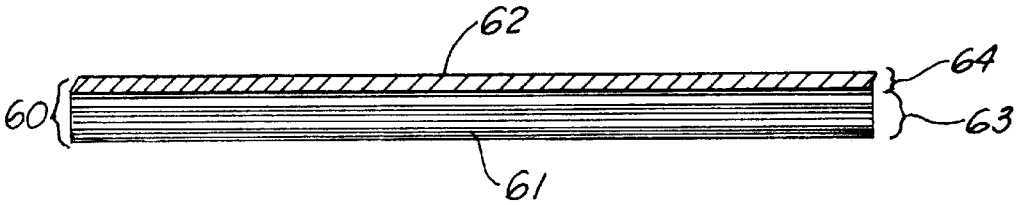
FIG. 5 is a cross-sectional view of an exemplary co-extrusion of thermoplastic film, illustrating a base extrusion of primarily HDPE, and a top extrusion of primarily LDPE.

FIG. 4 sets forth a flow chart illustrating the basic steps in forming the bag pack of the present invention. As shown, the first step in the process is the formation of the film tube utilized in the manufacture of the bags in the bag stack. Referring to FIG. 5, the present system utilizes a co-extruded extrusion process, wherein the co-extruded film 60 comprises a first ply 61 of mostly HDPE (up to 70%+ HDPE, the remainder comprising, for example, color concentrate, and/or recycled resin), and a second ply 62 of MDPE, LDPE or LLDPE (linear low density polyethylene), said co-extruded film formed into a bag pack such that the HDPE forms the inner walls of the bag, and the LDPE or LLDPE forms the outer wall of the bag. An exemplary co-extruder machine is manufactured by Alpine Gb of Germany.

In the present invention, the first ply, formed of HDPE, may have a density 63 comprising up to, for example, 70+% of the co-extruded, two ply film, while the second ply, formed of the LDPE or LLDPE, may only comprise 30−% of the density 64 of the co-extruded, two ply film. It is noted that the relative thicknesses of the plies in the figure is not particularly to scale, and is for illustrative purposes only. As earlier discussed, HDPE is a stronger film than LDPE, MDPE, or LLDPE, and it is therefore advantageous to have as high an HDPE content as possible. An exemplary film thickness for the overall co-extruded, two ply film would be, for example, 0.53 mils, with the first ply comprising, for example, 0.371 mils and the second ply comprising 0.159 mils.

As earlier discussed, the present system allows one to utilize, proportionally, a lesser percentage of low density or linear low density polyethylene in a two ply, coextruded context, than would be implemented in a typical monoextrusion context, and providing a first ply comprising mostly HDPE, resulting in superior strength, better bonding, and at a perceived lesser overall material cost.

Figure 7:
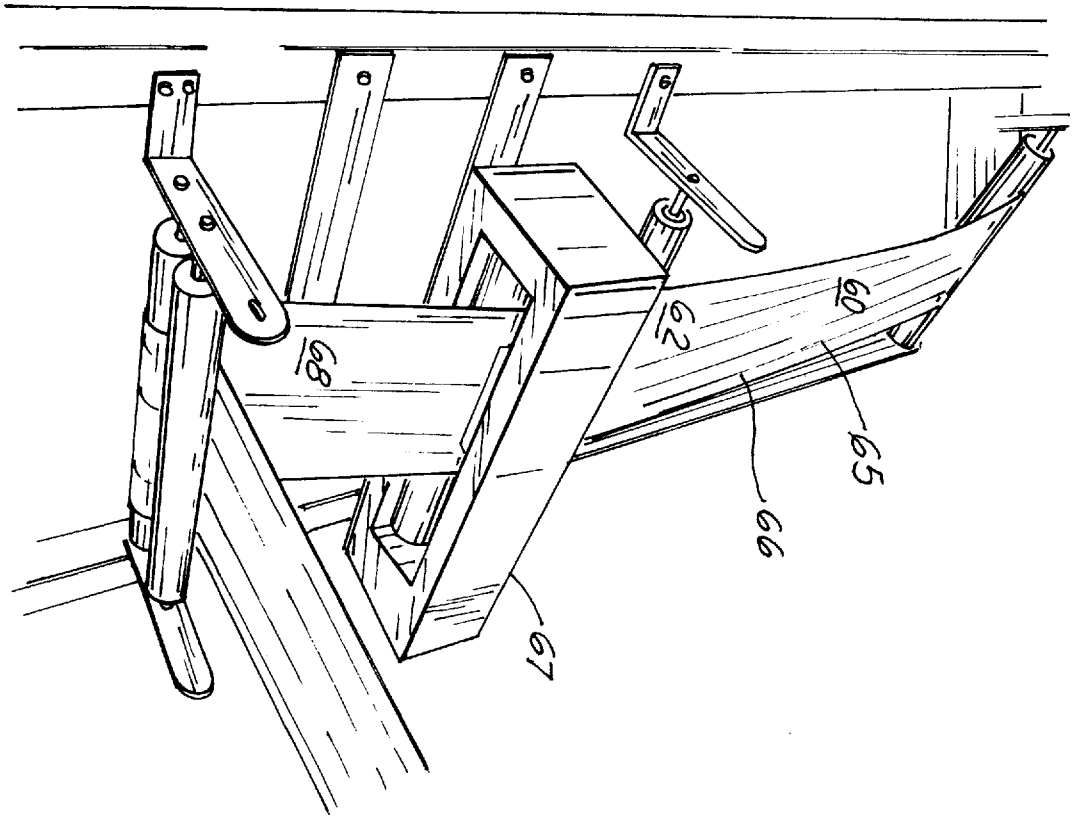
FIG. 7 is an isometric view of corona treatment of the film tube of the present invention following co-extrusion.
Figure 8:
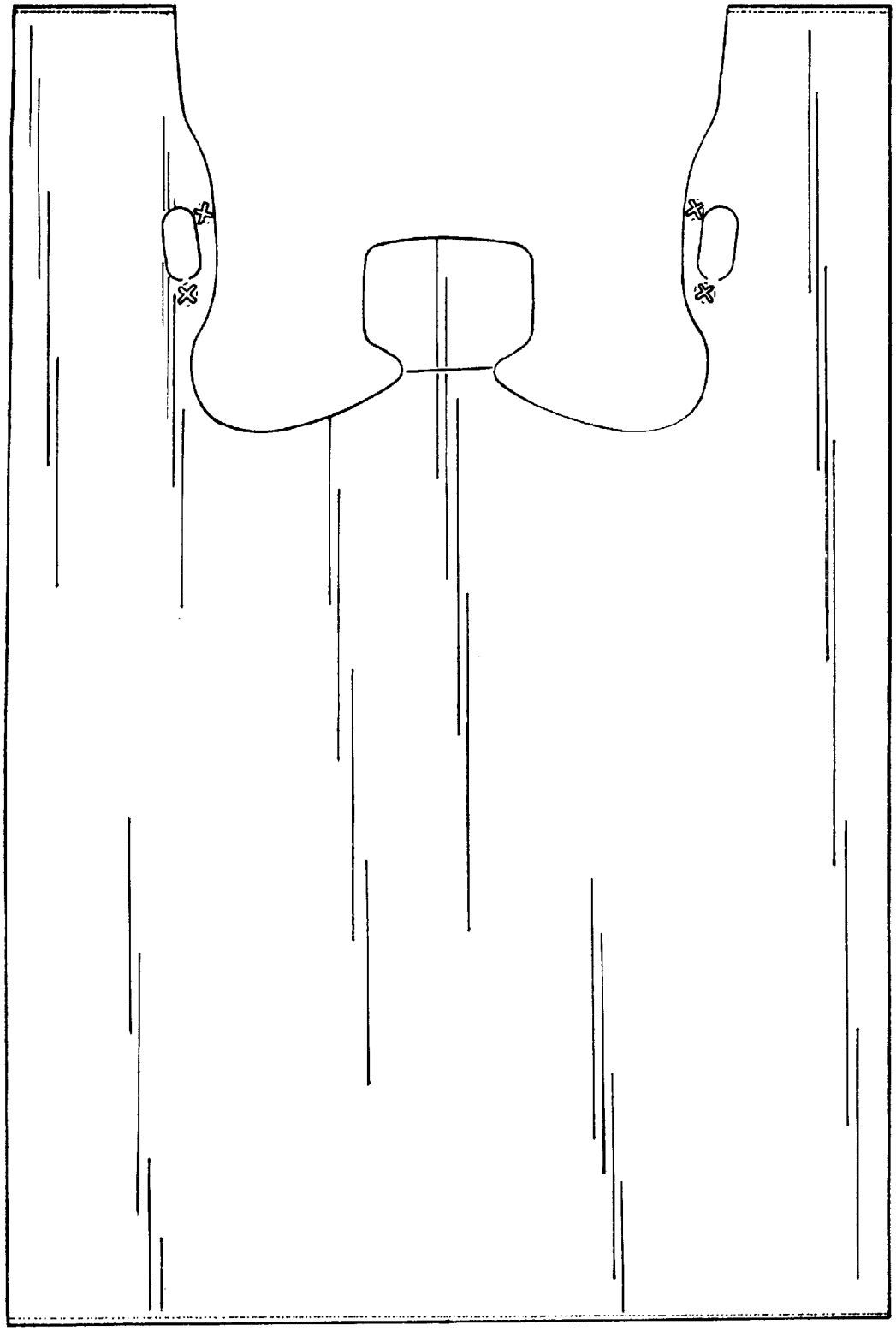
FIG. 8 illustrates an alternative placement of the self opening punches of the present invention.

Returning to FIG. 4, the next step in the fabrication process is to flatten the film tube, then exposure of the co-extruded film tube to a corona field. As shown in FIG. 7, the extruded film tube 66, formed from the co-extruded film 60, is situated such that the outer surface 65 of the tube comprises the LDPE or LLDPE second ply 62, and the inner surface of the tube comprises the HDPE first ply 61, is passed through a corona field facilitated by a corona field generator 67, corona treating 68 the outer, second ply of the co-extruded film.

In the exemplary embodiment of the present system, the film tube is progressing through the corona field at a speed of about 50–80 meters per minute, and the corona field has a strength of about, for example, 40–48 dynes (or even 49 or 50 dynes)depending upon the quality of the resin and film thickness. This setting is higher than traditional corona treatment settings for treatment of the film for providing a printing surface.

It is perceived that the corona treated, LDPE or LLDPE outer surface of the film further enhances the self-opening properties of the present system, providing better melding of the punched, cut edges of the punched handle areas of the bag stack.

Returning to FIG. 4, the corona treated film tube is then gusseted, as is traditionally done in the industry, forming gussets longitudinally along the length of the flattened film tube. The tube is then cut and sealed to form bag blanks, as they are known, and the bag blanks are assembled into a stack for die cutting, to form a bag pack.

A die D such as that shown in FIG. 6 is employed to form the stack into a bag pack. As shown, the die includes a main blade 70 which forms the handles and mouth of the bag pack, further including the tab area, further formed by a tab support blade 76, and a tab breakaway blade 77. The handle tabs, as earlier discussed, area formed by first and second tab blades 72, 72', respectively. Each of the blades of the die is mounted to a base 71 which may be formed, for example, of wood, the blades in the present invention emanating in generally lateral fashion from the base, having sharp edges distal the base.

Also emanating from the base 71 of the die is the self opening punches, comprising first 73 and second 74 punches, forming self opening punch 30', 31' areas as set forth on FIG. 2A, respectively, and back to FIG. 6, third 73' and forth 74' punches, forming self opening punch 30", 31", respectively. Also provided is tab punches 75, 75' for permanently fusing the tabs together.

The die engages and cuts the bag blank stack as is traditionally done in the industry. For exemplary purposes, the hydraulic driver driving the die of the present invention is set at 80–90 barr for driving the die blades and punches into a bag pack of, for example, 50 high density thermoplastic bags. The die may be heated as is done in the industry, or may be cold, depending upon the resin formulation, speed, number of bags in the bag stack, and other criteria.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

ELEMENTS OF THE INVENTION

Description
B Bag
D Die
P Bag Pack
P' Pulling
R Rack
H', H" Handle support members T Tab support member
T' Tapered
U User
L Lead bag
N Next bag
1 first side
2 second side
3 bottom end
4 top end
5 mouth
6 second handle
7 first handle
8 first inner side edge
9 second inner side edge
10 first handle support cut
11 second handle support cut
12 first tab
13 second tab
14 tab connection
15 tab connection
16 first bag handle inner edge
17 second bag handle inner edge
18
19
20
21
22 dispensing tab
23 upper bulbous portion
24 tab neck
25 end
26 tab support cut
27 first end "
28 second end "
29 bag pack punch
30', 30" first punch
31', 31" second punch
32 first bag wall
33 second bag wall
34
35
36 break tab bond
37
38
39 first longitudinal punch member
40 second "
41
42 cross configured punch
43 first lateral punch member
44 second"
45
46
47
48
49
50 Flow chart-coextrusion
51 corona field
52 gusseting/bag stack
53 fusing/formation/punch
54
55
56
57
58
59
60 co-extruded film
61 first ply HDPE
62 second ply LDPE
63 density-first ply
64 density-second ply
65 outer surface of film tube
66 extruded film tube
67 corona treatment unit
68 corona treated LDPE outer surface
69
70 blade
71 base
72 first tab blade
72' second tab blade
73 first punch
73' first punch
74 second punch
74' second punch
75 tab punch
75' tab punch
76 tab support blade
77 tab breakaway blade
78
79
80

What is claimed is:

1. A thermoplastic bag pack having first and second sides and bottom and top ends, said bag pack comprising a plurality of stacked, aligned bags, each of said bags comprising:

a bag mouth (5) having opposing ends and a medial area;

first (7), and second (6) handles emanating from said bag mouth, each of said handles having an upper end, a lower end, an inner side edge (8,9), and a medial area therebetween; each of said handles further having a handle support cut (10,11) formed in the medial area of said handles;

said bag pack further comprising first and second punch stamps formed in each of said first and second handles, said first and second punch stamps formed in said handles generally adjacent to the handle support cut formed in said handles;

said first and second punch stamps formed by first and second punches, each having a tip including first and second cutting edges.

2. The thermoplastic bag of claim 1, wherein said first and second cutting edges of said tip of said first and second punches are configured to form a cross.

3. The thermoplastic bag of claim 1, wherein said first and second cutting edges of said tip of said first and second punches are configured to form an X.

4. The thermoplastic bag of claim 1, wherein said first and second cutting edges of said tip are generally linear.

5. The thermoplastic bag of claims 1, 2, 3, or 4, wherein said bag is formed of thermoplastic film, said thermoplastic film having two plies, a first ply comprising primarily HDPE, and a second ply comprising polyethelyne having a density of less than 0.94.

6. The thermoplastic bag of claim 5, wherein said bag is formed of thermoplastic film, said thermoplastic film having two plies, a first ply comprising primarily HDPE, and a second ply comprising primarily LLDPE.

7. The thermoplastic bag of claim 5, wherein said bag has an interior portion and an exterior portion, and wherein first ply of said thermoplastic film forming said bag is situated primarily along said interior portion of said bag, and wherein said second ply of said thermoplastic film forming said bag is situated primarily along said exterior of said bag.

8. The thermoplastic bag of claim 6, wherein said bag has an interior portion and an exterior portion, and wherein first ply of said thermoplastic film forming said bag is situated primarily along said interior portion of said bag, and wherein said second ply of said thermoplastic film forming said bag is situated primarily along said exterior of said bag.

9. The thermoplastic bag of claim 7, wherein said thermoplastic film has been corona treated.

10. The thermoplastic bag of claim 8, wherein said thermoplastic film has been corona treated.

11. A thermoplastic bag pack having first and second sides and bottom and top ends, said bag pack comprising a plurality of stacked, aligned bags, each of said bags comprising:

a bag mouth (5) having opposing ends and a medial area;

first (7) and second (6) handles emanating from said bag mouth, each of said handles having an upper end, a lower end, an inner side edge (8,9), and a medial area therebetween; each of said handles further having a handle support cut (10,11) formed in the medial area of said handles;

said bag pack further comprising first and second punch stamps formed in each of said first and second handles, said first and second punch stamps formed in said handles generally adjacent to the handle support cut formed in said handles;

said first and second punch stamps, each said stamps including first and second, generally linear cut sections formed in said bag pack, said cut sections penetrating said handle areas of bags forming said bag pack.

12. The thermoplastic bag pack of claim 11, wherein said first and second linear cut sections formed in said bag pack intersect.

13. The thermoplastic bag pack of claim 11, wherein said second punch stamp formed in said bag pack is of lesser dimensions than said first punch stamp formed in said bag pack.

14. The method of dispensing individual bags from a bag pack on a rack by a user, the rack having first and second somewhat horizontally situated handle support members, and a tab support member, comprising the steps of:

a) providing a bag pack comprising a plurality of stacked bags, said bag pack further comprising binding means for releasably binding said bags to one another in stacked fashion, forming said pack, each of said bags having front and rear walls, first and second sides and bottom and top ends, each of said bags further comprising:

a bag mouth (5) having opposing ends and a medial area;

first (7) and second (6) handles emanating from said bag mouth, each of said handles having an upper end, a lower end, an inner side edge (8,9), and a medial area therebetween; each of said handles further having a handle support cut (10,11) formed in the medial area of said handles;

a tab having a top edge, said tab emanating from said bag mouth, said tab comprising a bulbous section having formed therein a generally linear tab cut, forming a rupture zone;

said tab cut and said handle support members configured to cooperate in supporting said thermoplastic bag pack on said rack, said tab cut configured to accept the tab support member of the rack in such a fashion as to support the bag mouth, said handle support cut of each of said first and second handles configured to spread and accept the first and second handle support members of the rack, respectively;

said binding means further comprising first and second punch stamps formed in each of said first and second handles, in both the front and rear walls of each bag in said pack, said first and second punch stamps formed in said handles generally adjacent to the handle support cut formed in said handles;

said first and second punch stamps formed by first and second punches, respectively, each of said punches having tips having first and second, generally linear, cutting edges;

said cutting edges of said tips of said first and second punch stamps penetrating the handle area of bags forming the bag stack, partially melding the rear wall of the lead bag on said bag stack with the front wall of a next bag on said stack;

b) spreading the handle support cut of each of said first and second handles or each of said bags in said bag pack to form a handle opening for each of said first and second handles;

c) directing the handle opening of the first handle of each of said bags in said bag pack about the first handle support member, supporting said first handle on the rack;

d) directing the handle opening of the second handle of each of said bags in said bag pack about the second handle support member, supporting said second handle on the rack;

e) directing the tab cut of said tab of each of said bags in said bag pack about the tab support member, supporting said tab on the rack;

f) dispensing a bag, comprising the steps of pulling the front wall of the lead bag away from the rack, spacing said front wall of said bag in a spaced, removed position relative the rear wall of said bag, opening said bag mouth;

g) loading said lead bag with goods;

h) grasping the handles of the lead bag, and directing same away from the rack;

I) allowing the partially melded bag walls formed in the rear wall of said lead bag to pull the front wall of the next bag on the pack away from the pack, as the user pulls the front wall of the lead bag away from the rack, such that front wall of said next bag is separated from the rear wall, and said next bag is dispensed in an open position;

j) separating the partially melded rear wall of the lead bag on said bag pack from the front wall of a next bag on said stack as the lead bag is removed from said rack.

15. A method of forming a bag, comprising the steps of:

a) co-extruding a length of film tube, said co-extrusion comprising first and second plies, forming inner and outer sides of said tube, respectively, said first, inner ply of said tube formed mostly of HDPE, said second, outer ply of said tube formed mostly of olyethelyne resin having a density of less than 0.94, forming an inner wall of HDPE and an outer wall of lesser density polyethelyne;

b) exposing said length of film tube to a corona field of between 38–45 dynes;

c) forming said film tube into a bag pack comprising a plurality of bags, further comprising the steps of:

I) forming in each bag a bag mouth (5) having opposing ends and a medial area;

ii) forming in each bag first (7) and second (6) handles emanating from said bag mouth, each of said handles having an upper end, a lower end, an inner side edge (8,9), and a medial area therebetween; each of said handles further having a handle support cut (10,11) formed in the medial area of said handles;

iii) utilizing a die punch having a cutting edge, penetrating each of said first and second handles of said bag, as well as adjacent first and second handles, respectively, of said adjoining bags;

iv) said cutting edge of said die punch releasably melding outer walls of adjacent bags in the vicinity of said penetration area.

16. The method of claim 15, wherein said die punch is formed of first and second, generally linear, cutting edges.

17. The method of claim 16, wherein said first and second cutting edges intersect.

18. The method of claim 15, wherein there are included, following step "c", the additional steps of d) spreading the handle support cut of each of said first and second handles or each of said bags in said bag pack to form a handle opening for each of said first and second handles;

e) directing the handle opening of the first handle of each of said bags in said bag pack about the first handle support member, supporting said first handle on the rack;

f) directing the handle opening of the second handle of each of said bags in said bag pack about the second handle support member, supporting said second handle on the rack;

g) directing the tab cut of said tab of each of said bags in said bag pack about the tab support member, supporting said tab on the rack;

h) dispensing a bag, comprising the steps of pulling the front wall of the lead bag away from the rack, spacing said front wall of said bag in a spaced, removed position relative the rear wall of said bag, opening said bag mouth;

I) loading said lead bag with goods;

j) grasping the handles of the lead bag, and directing same away from the rack;

k allowing the partially melded bag walls formed in the rear wall of said lead bag to pull the front wall of the next bag on the pack away from the pack, as the user pulls the front wall of the lead bag away from the rack, such that front wall of said next bag is separated from the rear wall, and said next bag is dispensed in an open position;

l) separating the partially melded rear wall of the lead bag on said bag pack from the front wall of a next bag on said stack as the lead bag is removed from said rack.

* * * * *